US007766260B2

(12) United States Patent
Lin

(10) Patent No.: US 7,766,260 B2
(45) Date of Patent: Aug. 3, 2010

(54) SHOWERHEAD

(76) Inventor: Wen-Yi Lin, No. 62, Hsinan Chuang, Fushan Li, Changhua City (TW)

( * ) Notice: Subject to any disclaimer, the term of this patent is extended or adjusted under 35 U.S.C. 154(b) by 351 days.

(21) Appl. No.: 12/029,891

(22) Filed: Feb. 12, 2008

(65) Prior Publication Data

US 2009/0200400 A1 Aug. 13, 2009

(51) Int. Cl.

| | |
|---|---|
| ***A62C 31/00*** | (2006.01) |
| *A62C 31/02* | (2006.01) |
| *B05B 1/34* | (2006.01) |
| *B05B 7/02* | (2006.01) |
| *B05B 1/30* | (2006.01) |
| *B05B 1/00* | (2006.01) |

(52) U.S. Cl. ..... 239/449; 239/443; 239/444; 239/445; 239/446; 239/447; 239/448; 239/391; 239/533.13; 239/389; 239/525; 239/600

(58) Field of Classification Search ..... 239/600, 239/533.13, 569, 581.1, 581.2, 582.1, 391, 239/570, 574, 583, 586, 587.3, 589, 590.3, 239/590.5, 380, 389, 525, 443–449

See application file for complete search history.

(56) References Cited

U.S. PATENT DOCUMENTS

| | | | | | |
|---|---|---|---|---|---|
| 3,545,681 | A | * | 12/1970 | Buckley | 239/449 |
| 3,963,179 | A | * | 6/1976 | Tomaro | 239/101 |
| 4,204,646 | A | * | 5/1980 | Shames et al. | 239/381 |
| 4,330,089 | A | * | 5/1982 | Finkbeiner | 239/381 |
| 4,629,124 | A | * | 12/1986 | Gruber | 239/428.5 |
| 4,674,687 | A | * | 6/1987 | Smith et al. | 239/447 |
| 4,703,893 | A | * | 11/1987 | Gruber | 239/391 |
| 5,033,897 | A | * | 7/1991 | Chen | 401/281 |
| 5,090,624 | A | * | 2/1992 | Rogers | 239/381 |
| 5,100,055 | A | * | 3/1992 | Rokitenetz et al. | 239/11 |
| 5,145,114 | A | * | 9/1992 | Monch | 239/126 |
| 5,297,735 | A | * | 3/1994 | Heimann et al. | 239/120 |
| 5,356,078 | A | * | 10/1994 | Bischoff | 239/447 |
| 5,467,927 | A | * | 11/1995 | Lee | 239/383 |
| 5,499,767 | A | * | 3/1996 | Morand | 239/383 |
| 5,551,637 | A | * | 9/1996 | Lo | 239/394 |
| 5,632,446 | A | * | 5/1997 | Krochek | 239/381 |
| 5,707,011 | A | * | 1/1998 | Bosio | 239/447 |
| 5,730,362 | A | * | 3/1998 | Cordes | 239/123 |
| 5,765,760 | A | * | 6/1998 | Kuo | 239/440 |
| 5,772,120 | A | * | 6/1998 | Huber | 239/391 |
| 5,860,599 | A | * | 1/1999 | Lin | 239/443 |

(Continued)

*Primary Examiner*—Dinh Q Nguyen
*Assistant Examiner*—Steven M Cernoch
(74) *Attorney, Agent, or Firm*—Eschweiler & Associates, LLC

(57) ABSTRACT

A switchable showerhead has a body, a switching device, a water-spraying device and an operating device. The body has a mounting recess, a front through hole, a rear through hole, a mounting chamber, a connecting frame, an inserting hole and an inner tube. The switching device is mounted in the body and has a holding element, a front guide base, a rear guide base and a valve stem. The valve stem is movably mounted in the guide bases. The water-spraying device is mounted in the body, communicates with the switching device and has a shell and a cover. The shell is mounted in the mounting recess. The cover is mounted on the shell and has an inserting tube and multiple spouts. The operating device is mounted on the body, is connected to the switching device and has an operating panel connected to the valve stem.

6 Claims, 5 Drawing Sheets

U.S. PATENT DOCUMENTS 5,918,816 A * 7/1999 Huber ..... 239/391
6,045,062 A * 4/2000 Bosio ..... 239/443
6,076,743 A * 6/2000 Fan ..... 239/99
6,113,010 A * 9/2000 Wu-Hsiung ..... 239/530
6,151,729 A * 11/2000 Yean ..... 4/675
6,227,464 B1 * 5/2001 Allmendinger et al. ..... 239/525
6,290,147 B1 * 9/2001 Bertrand et al. ..... 239/444
6,367,710 B2 * 4/2002 Fan ..... 239/99
6,370,713 B2 * 4/2002 Bosio ..... 4/677
6,412,711 B1 * 7/2002 Fan ..... 239/446
6,622,945 B1 * 9/2003 Wu et al. ..... 239/443
6,715,699 B1 * 4/2004 Greenberg et al. ..... 239/394
6,742,725 B1 * 6/2004 Fan ..... 239/525
7,070,125 B2 * 7/2006 Williams et al. ..... 239/443
7,303,151 B2 * 12/2007 Wu ..... 239/447
7,316,364 B2 * 1/2008 Larsen ..... 239/589
7,320,442 B2 * 1/2008 Bosio ..... 239/569
7,328,858 B2 * 2/2008 Bosio ..... 239/444
7,380,731 B1 * 6/2008 Hsu ..... 239/447
2001/0010342 A1 * 8/2001 Allmendinger et al. ..... 239/525
2004/0164183 A1 * 8/2004 Nobili ..... 239/449
2004/0227014 A1 * 11/2004 Williams et al. ..... 239/443
2005/0103896 A1 * 5/2005 Bosio ..... 239/446
2005/0145725 A1 * 7/2005 Chan ..... 239/530
2006/0016912 A1 * 1/2006 Nobili ..... 239/525
2006/0261191 A1 * 11/2006 Chang ..... 239/525
2006/0289680 A1 * 12/2006 Huang ..... 239/445
2007/0200014 A1 * 8/2007 Nobili ..... 239/569
2007/0210181 A1 * 9/2007 Nobili ..... 239/68
2007/0221757 A1 * 9/2007 Malek et al. ..... 239/447
2007/0221760 A1 * 9/2007 Nobili ..... 239/569
2008/0023576 A1 * 1/2008 Boesch ..... 239/446
2008/0156902 A1 * 7/2008 Luettgen et al. ..... 239/447
2009/0200401 A1 * 8/2009 Esche et al. ..... 239/525

* cited by examiner

SHOWERHEAD

BACKGROUND OF THE INVENTION

1. Field of the Invention

The present invention relates to a switchable showerhead, which enables a user to select the types of water streams spraying from the showerhead easily and can be assembled quickly.

2. Description of Related Art

A conventional showerhead is attached to a pipe that is mounted on a wall and connected to a water source, and the conventional showerhead has a front face and multiple outlets defined in the front face to allow water to spray out of the conventional showerhead.

However, the conventional showerhead only has a single kind of water stream exiting out from the front face of the conventional showerhead and cannot provide another type of water stream, so this will limit the use of the showerhead.

To overcome the shortcomings, the present invention tends to provide a switchable showerhead to mitigate or obviate the aforementioned problems.

SUMMARY OF THE INVENTION

The primary objective of the present invention is to provide a switchable showerhead, such that the showerhead can be operated with different types of water streams easily and can be assembled quickly.

The switchable showerhead in accordance with the present invention has a body, a switching device, a water-spraying device and an operating device. The body has a mounting recess, a front through hole, a rear through hole, a mounting chamber, a connecting frame, an inserting hole and an inner tube. The switching device is mounted in the body and has a holding element, a front guide base, a rear guide base and a valve stem. The valve stem is movably mounted in the guide bases. The water-spraying device is mounted in the body and communicates with the switching device and has a shell and a cover. The shell is mounted in the mounting recess. The cover is mounted on the shell and has an inserting tube and multiple spouts. The operating device is mounted on the body and is connected to the switching device and has an operating panel connected to the valve stem.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
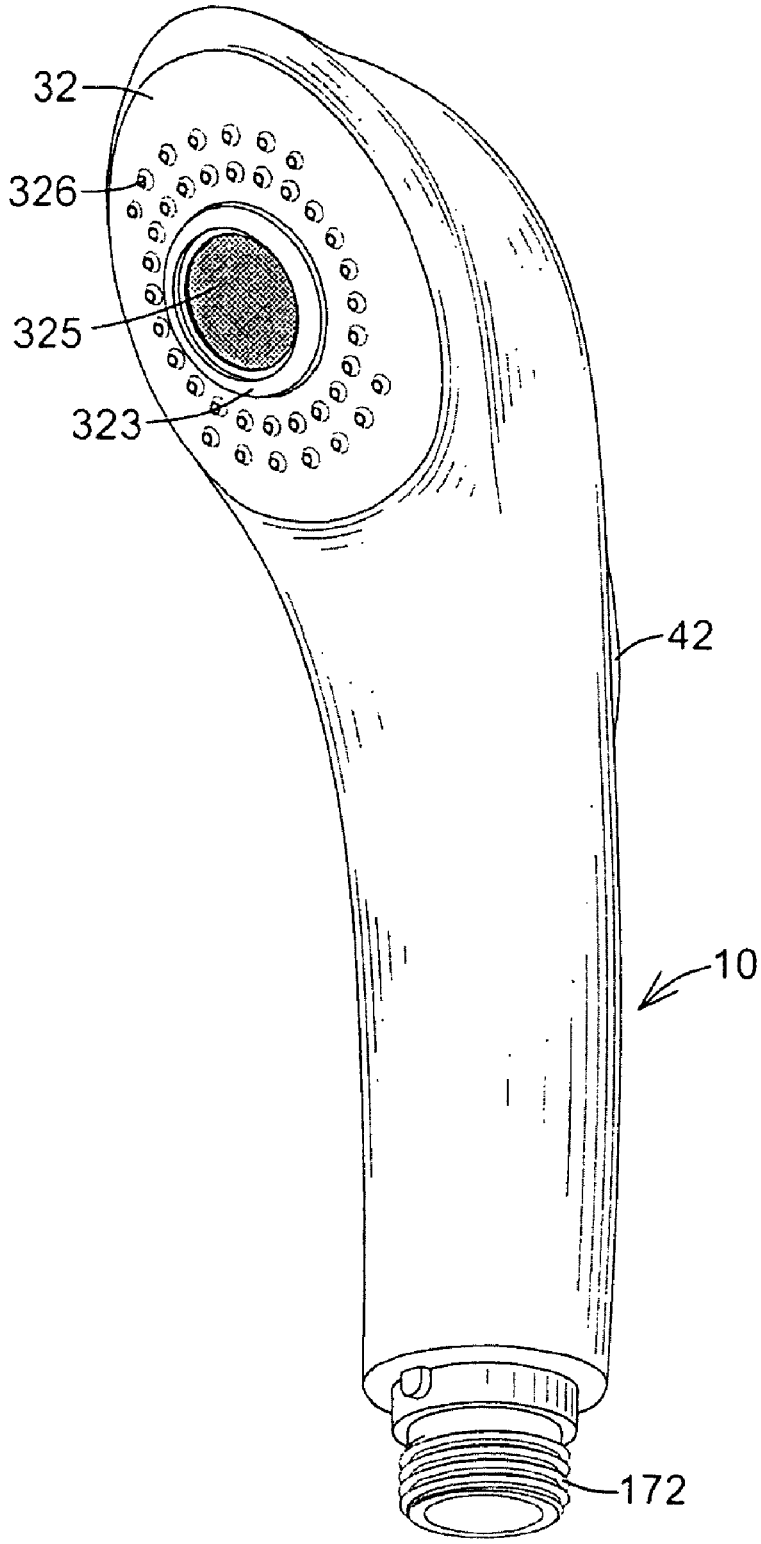
FIG. 1 is a perspective view of a switchable showerhead in accordance with the present invention.
Figure 2:
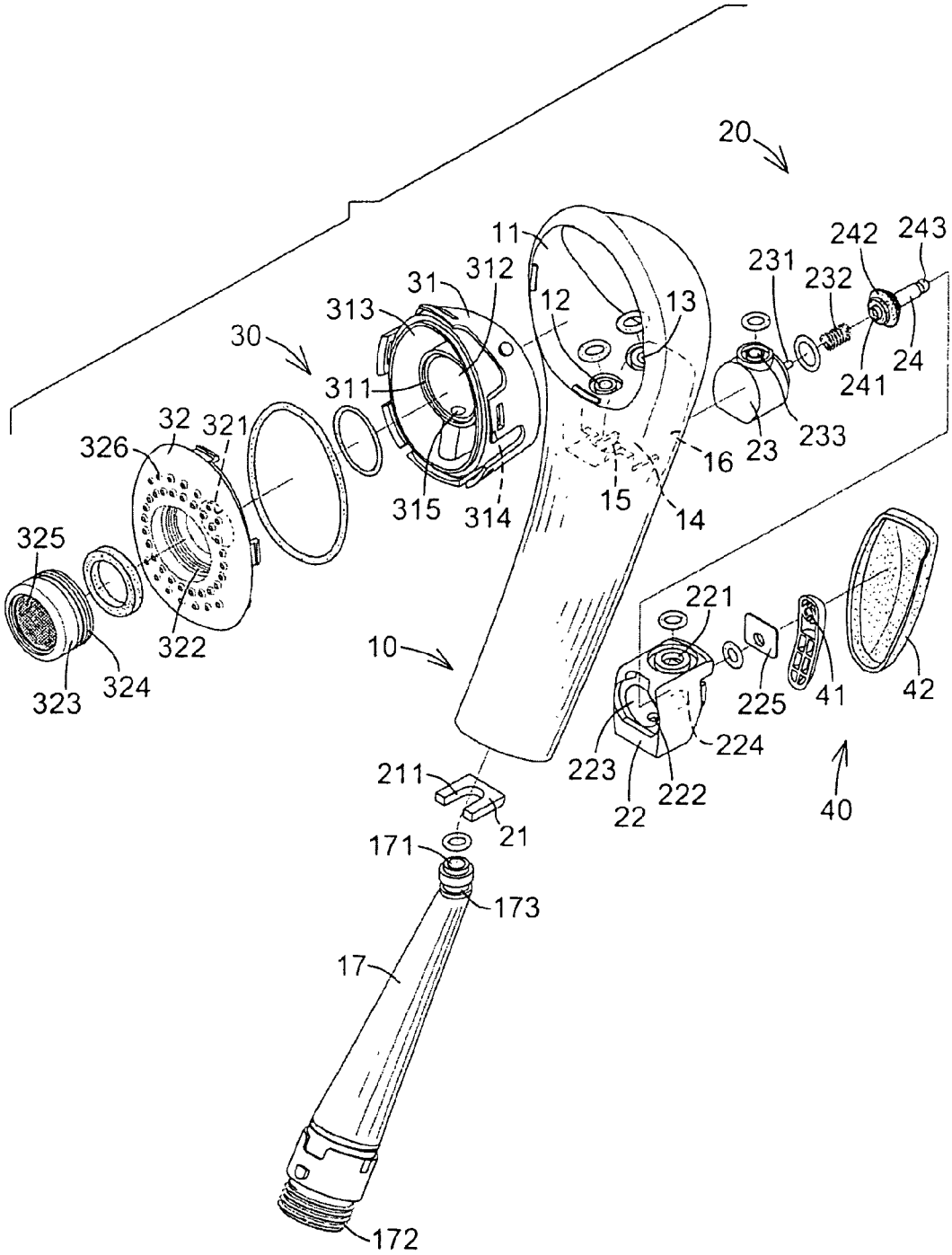
FIG. 2 is an exploded perspective view of the switchable showerhead in FIG. 1.

With reference to FIGS. 1 and 2, a switchable showerhead in accordance with the present invention comprises a body (10), a switching device (20), a water-spraying device (30) and an operating device (40).

The body (10) may be a hollow cylinder and has a proximal end, a distal end a front face, a rear face, a mounting recess (11), a front through hole (12), a rear through hole (13), a mounting chamber (14), a connecting frame (15), an inserting hole (16) and an inner tube (17).

The mounting recess (11) is formed in the front face of the body (10) near the distal end and has an opening and a sidewalk The opening is formed through the front face of the body (10). The front through hole (12) is formed in the sidewall of the mounting recess (11) near the opening. The rear through hole (13) is formed in the sidewall of the mounting recess (11) away from the opening. The mounting chamber (14) is formed in the rear face of the body (10) below the mounting recess (11) and communicates with the front and rear through holes (12, 13). The connecting frame (15) is formed in the body (10) between the mounting recess (11) and the mounting chamber (14). The inserting hole (16) is formed through the rear face of the body (10) below the mounting recess (11) and communicates with the mounting chamber (14). The inner tube (17) is mounted securely in the body (10) and has an external surface, an inner end (171), a connecting end (172) and an annular groove (173). The inner end (171) is mounted in the mounting chamber (14) via the connecting frame (15). The connecting end (172) of the inner tube (17) extends out the proximal end of the body (10) and is adapted to connect to a pipe. The annular groove (173) is formed around the external surface of the inner tube (17) near the inner end (171).

Figure 3:
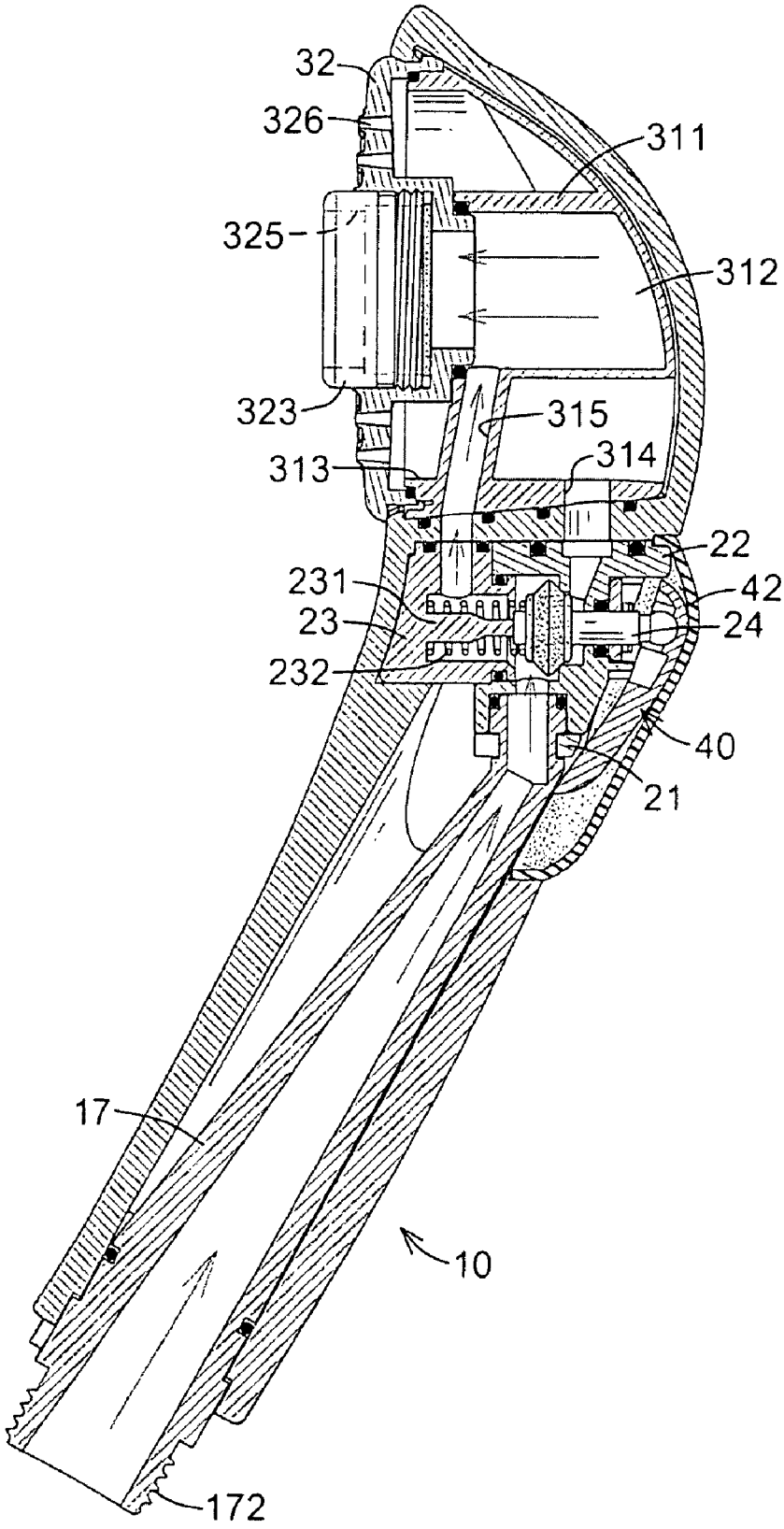
FIG. 3 is an operational side view in partial section of the switchable showerhead in FIG. 1.

With further reference to FIG. 3, the switching device (20) is mounted in the body (10) and has a holding element (21): a from guide base (23)T a rear guide base (22) and a valve stem (24).

The holding element (21) is mounted in the mounting chamber (14) and has an engaging hole (211) formed through the holding element (21) and mounted in and engaging the annular groove (173) of the inner tube (17).

The front guide base (23) is hollow, is mounted in the mounting chamber (14), contacts with the sidewall of the mounting recess (11) and has a top, a rear side, a mounting post (231), a spring (232) and a circular hole (233). The mounting post (231) is formed in the front guide base (23) and protrudes out the rear side of the front guide base (23). The spring (232) is mounted around the mounting post (231). The circular hole (233) is formed in the lop of the front guide base (23) and communicates with the front through hole (12) of the body (10).

The rear guide base (22) may be a hollow and square block, is mounted in the mounting chamber (14) at a location between the sidewall of the mounting recess (11) and the holding element (21) and is mounted around the inner end (171) of the inner tube (17). The rear guide base (22) has a top, a bottom, a front side, a rear side, an upper hole (221), an inner passage, a mounting tube (222), a mounting hole (223), a stem hole (224) and a connecting panel (225). The upper hole (221) is formed in the top of the rear guide base (22) and communicates with the rear through hole (13) of the body (10). The inner passage is formed in the rear guide base (22)

and communicates with the upper hole (221). The mourning tube (222) is formed on and protrudes from the bottom of the rear guide base (22) and is mounted around the inner end (171) of the inner lube (17) and communicates with the inner passage. The mounting hole (223) is formed in the front side of the rear guide base (22) and is mounted around the rear side of the front guide base (23) and communicates with the inner passage. The stem hole (224) is formed in the rear side of the rear guide base (22) and aligns with the mounting post (231). The connecting panel (225) is attached to the rear side of the rear guide base (22) and has a central hole formed through the connecting panel (225) and aligning with the stem hole (224).

The valve stem (24) is movably mounted around one end of the mounting post (231) between the guide bases (22, 23) and has an inner end, an outer end, an external surface, a post hole (241), a valve ring (242) and a mounting head (243). The post hole (241) is formed axially in the inner end of the valve stem (24) and is mounted around the end of the mounting post (231) on the front guide base (23). The outer end of the valve stem (24) protrudes out the rear guide base (22) through the stem hole (224) and is mounted through the central hole of the connecting panel (225). The valve ring (242) is formed around the external surface of the valve stem (24) near the inner end, is mounted in the mounting hole (223) of the rear guide base (22) and faces to the rear side of the front guide base (23), and the spring (232) pushes the valve ring (242) against the rear guide base (22) to cover the inner passage of the rear guide base (22). Then, the mounting tube (222) cannot communicate with the upper hole (221) via the inner passage of the rear guide base (22). The mounting head (243) may be spherical and is formed on the outer end of the valve stem (24).

The water-spraying device (30) is mounted in the body (10), communicates with the switching device (20) and has a shell (31) and a cover (32).

The shell (31) is mounted in the mounting recess (11) and has a center, a sidewall, a discharge tube (311), an inner channel (312), an outer channel (313), a guiding hole (314) and a guiding tube (315). The discharge tube (311) is formed axially on the center of the shell (31) to divide the shell (31) into the inner channel (312) and the outer channel (313). The guiding hole (314) is formed through the sidewall of the shell (31) and communicates with the outer channel (313), the rear through hole (13) of the body (10) and the upper hole (221) of the rear guide base (22). The guiding tube (315) is formed radially on the shell (31) between the discharge lube (311) and the sidewall of the shell (31) and communicates with the inner channel (312), the front through hole (12) of the body (10) and the circular hole (233) of the front guide base (23).

The cover (32) is detachably mounted on the shell (31) and has an inner face, an outer face, an inserting tube (321), an injecting head (323) and multiple spouts (326). The inserting tube (321) is formed on and protrudes from a center of the inner face of the cover (32), is mounted in the discharge tube (311) of the shell (31) and communicates with the inner channel (312) and has an internal surface and an inner thread (322). The inner thread (322) is formed on the internal surface of the inserting tube (321). The injecting head (323) is detachably mounted in the inserting lube (321) and has an external surface, a front face, an outer thread (324) and multiple injecting holes (325). The outer thread (324) is formed on the external surface of the injecting head (323) and screws with the inner thread (322) of the inserting tube (321). The injecting holes (325) are formed through the front face of the injecting head (323) and communicates with the inner channel (312). The spouts (326) are formed through the outer face of the cover (32) around the inserting lube (321) and communicate with the outer channel (313) of the shell (31).

The operating device (40) is mounted on the body (10) and is connected to the switching device (20) and has an operating panel and a pressing cap (42). The operating panel may be curve, is connected to the valve stem (24) of the switching device (20) via the inserting hole (16) of the body (10) and has an inner face, an upper end and a holding tube (41). The holding tube (41) is formed on the inner face of the operating panel near the upper end and is mounted around the mounting, head (243) of the valve stem (24). The pressing cap (42) is mounted on the rear face of the body (10) to cover the inserting hole (16) and contacts with the operating panel.

Figure 4:
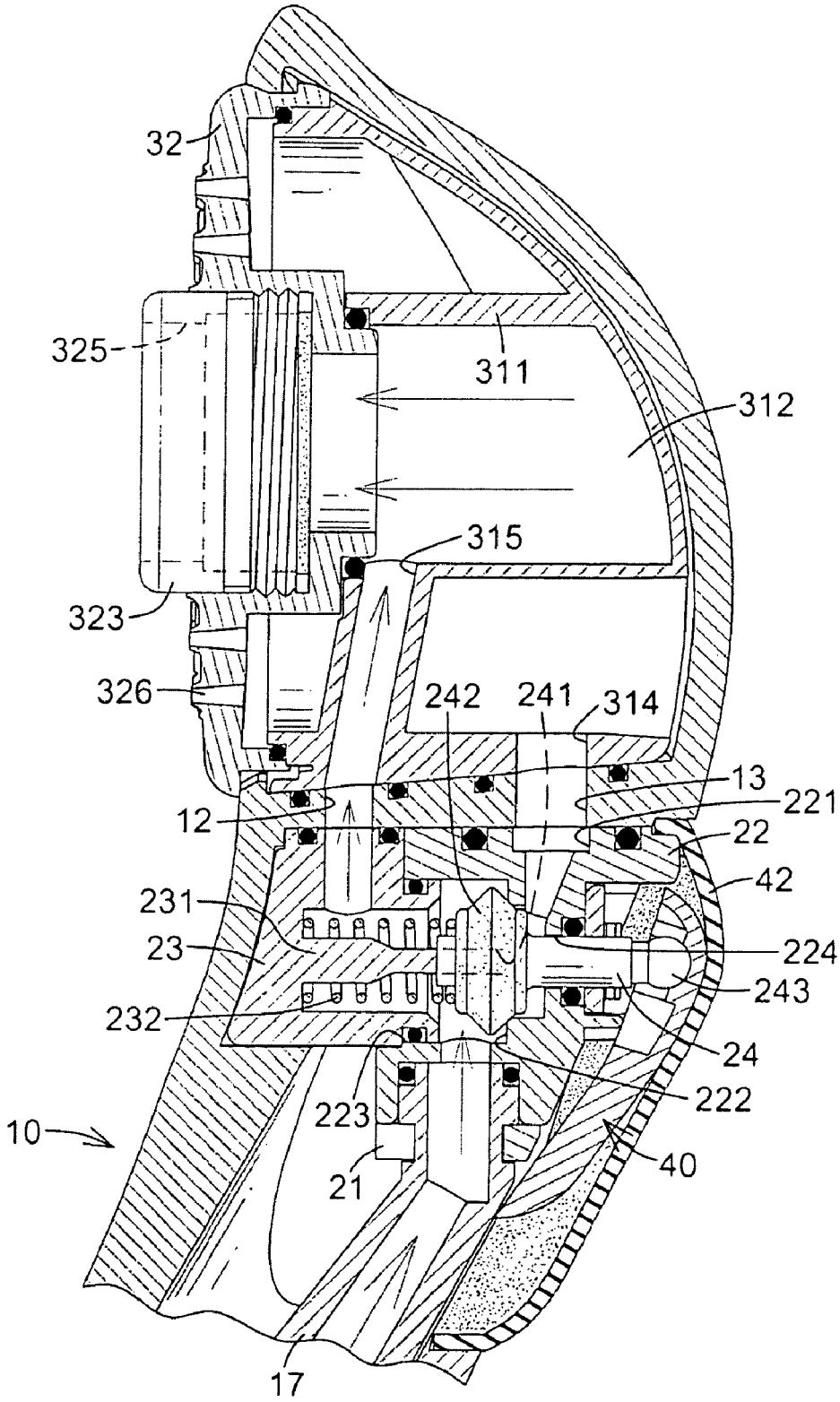
FIG. 4 is an enlarged side view in partial section of the switchable showerhead in FIG. 3.

With reference to FIGS. 3 and 4, the valve ring (242) of the valve stem (24) is pushed to cover the inner passage of the rear guide base (22) by the spring (232) to keep the upper hole (221) of the rear guide hole (22) from communicating with the mounting tube (222). When water enters the switchable showerhead from the connecting end (172) and the inner end (172) of the inner tube (17), the water will flow into the switching device (20) through the mounting tube (222) and the mounting hole (223) of the rear guide base (22) and the circular hole (233) of the front guide base (23). The water then Hows through the front through hole (12), the guiding tube (315), and into the inner channel (312) of the shell (31). Finally, the water is sprayed out of the showerhead through the inserting tube (321) and the injecting holes (325) of the injecting head (323) in a particular type of shower jet, due to a particular configuration and formation of the apertures of the injecting head (323).

Figure 5:
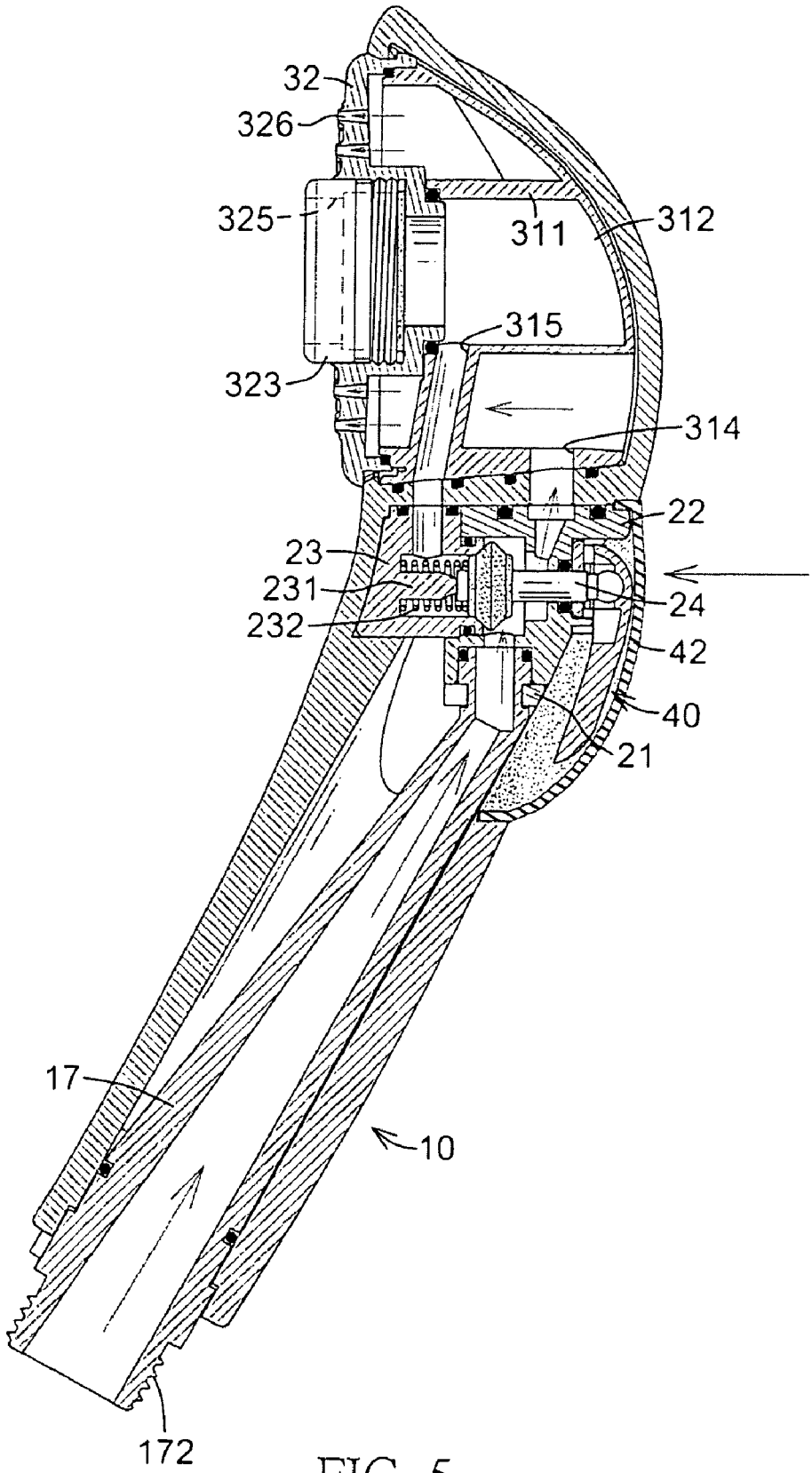
FIG. 5 is another operational side view in partial section of the switchable showerhead in FIG. 1.

With reference to FIG. 5, when a user presses the operating panel to push the vale stem (24) to move toward the front guide base (23), the pressure of the water will push the valve ring (242) against the front guide base (23) to keep the circular hole (233) from communicating with the mounting tube (222). Consequently, the water will flow into the rear guide base (22) and the outer channel (313) via the inner passage, the upper hole (221), the rear through hole (13) and the guiding hole (314). Then, the water is sprayed out of the showerhead through the spouts (326) of the cover (32) via the outer channel (313) in a particular type of shower jet, due to a particular configuration and formation of the apertures of the spouts (326).

From the above description, the switchable showerhead as described has the following advantages:

1. Users can press the operating panel of the operating device (40) to control the water flowing out the switchable showerhead from the injecting holes (325) or the spouts (326) to provide different types of water streams.

2. The switchable showerhead can be assembled without using fasteners and the cost for manufacturing and assembling the switchable showerhead is effectively reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A switchable showerhead comprising a body having a proximal end;

a distal end;

a front face;

a rear face;

a mounting recess being formed in the front face of the body near the distal end and having an opening being formed through the front face of the body: and a sidewall;

a front through hole being formed in the sidewall of the mounting recess near the opening;

a rear through hole being formed in the sidewall of the mounting recess away from the opening;

a mounting chamber being formed in the rear face of the body below the mounting recess and communicating with the front and rear through holes;

a connecting frame being formed in the body between the mounting recess and the mounting chamber;

an inserting hole being formed through the rear face of the body below the mounting recess and communicating with the mounting chamber; and an inner tube being mounted securely in the body and having an external surface;

an inner end being mounted in the mounting chamber via the connecting frame: and a connecting end extending out the proximal end of the body;

a switching device being mounted in the body and having a holding element being mounted in the mounting chamber;

a front guide base being hollow, being mounted in the mounting chamber, contacting with the sidewall of the mounting recess and having a top;

a rear side:

a mounting post being formed in the front guide base and protruding out the rear side of the front guide base;

a spring being mounted around the mounting post; and a circular hole being formed in the top of the front guide base and communicating with the front through hole of the body;

a rear guide base being mounted in the mounting chamber at a location between the sidewall of the mounting recess and the holding element, being mounted around the inner end of the inner tube and having a top;

a bottom:

a front side;

a rear side;

an upper hole being formed in the top of the rear guide base and communicating with the rear through hole of the body;

an inner passage being formed in the rear guide base and communicating with the upper hole;

a mounting tube being formed on and protruding from the bottom of the rear guide base and being mounted around the inner end of the inner tube and communicating with the inner passage;

a mounting hole being formed in the front side of the rear guide base and being mounted around the rear side of the front guide base and communicating with the inner passage; and a stem hole being formed in the rear side of the rear guide base and aligning with the mounting post; and a valve stem being movably mounted around one end of the mounting post between the front and rear guide bases and having an inner end;

an outer end;

an external surface;

a post hole being formed axially in the inner end of the valve stem and being mounted around the end of the mounting post on the front guide base; and a valve ring being formed around the external surface of the valve stem near the inner end, mounted in the mounting hole of the rear guide base and facing to the rear side of the front guide base, the spring pushes the valve ring against the rear guide base to cover the inner passage of the rear guide base to keep the upper hole from communicating with the mounting tube;

a water-spraying device being mounted in the body, communicating with the switching device and having a shell being mounted in the mounting recess and having a center;

a sidewall;

a discharge tube being formed axially on the center of the shell to divide the shell into an inner channel and an outer channel;

a guiding hole being formed through the sidewall of the shell and communicating with the outer channel, the rear through hole of the body and the upper hole of the rear guide base; and a guiding tube being formed radially on the shell between the discharge tube and the sidewall of the shell and communicating with the inner channel, the front through hole of the body and the circular hole of the front guide base; and a cover being detachably mounted on the shell and having an inner face;

an outer face;

an inserting tube being formed on and protruding from a center of the inner face of the cover, being mounted in the discharge tube of the shell and communicating with the inner channel; and multiple spouts being formed through the outer face of the cover around the inserting tube and communicating with the outer channel of the shell; and an operating device being mounted on the body, being connected to the switching device and having an operating panel connected to the valve stem of the switching device.

2. The switchable showerhead as claimed in claim 1, wherein the valve stem further has a spherical mounting head formed on the outer end of the valve stem; and the operating panel is curve and further has an inner face;

an upper end; and a holding tube being formed on the inner face of the operating panel near the upper end and being mounted around the mounting head of the valve stem.

3. The switchable showerhead as claimed in claim 2, wherein the body is a hollow cylinder;

the inner tube of the body further has an annular groove formed around the external surface of the inner tube near the inner end; and the holding element of the switching device further has an engaging hole being formed through the holding element and mounted in and engaging the annular groove of the inner tube.

4. The switchable showerhead as claimed in claim 3, wherein the inserting tube of the cover further has an internal surface; and an inner thread being formed on the internal surface of the inserting tube; and the cover further has an injecting head being detachably mounted in the inserting tube and having an external surface;

a front face:

an outer thread being formed on the external surface of the injecting head and screwing with the inner thread of the inserting tube; and multiple injecting holes being formed through the front face of the injecting head and communicating with the inner channel.

5. The switchable showerhead as claimed in claim 4, wherein the operating device further has a pressing cap being mounted on the rear face of the body to cover the inserting hole and contacting with the operating panel.

6. The switchable showerhead as claimed in claim 5, wherein the rear guide base is a hollow and square block and further has a connecting panel being attached to the rear side of the rear guide base and having a central hole being formed through the connecting panel and aligning with the stem hole; and the outer end of the valve stem protruding out the rear guide base through the stem hole and is mounted through the central hole of the connecting panel.

* * * * *